US007665780B2

(12) United States Patent
Vollmer

(10) Patent No.: US 7,665,780 B2
(45) Date of Patent: Feb. 23, 2010

(54) PET WASTE COLLECTION KIT, DEVICE AND METHOD

(76) Inventor: John Vollmer, 5791 Lampkins Ridge Rd., Bloomington, IN (US) 47401

( * ) Notice: Subject to any disclaimer, the term of this patent is extended or adjusted under 35 U.S.C. 154(b) by 641 days.

(21) Appl. No.: 11/390,647

(22) Filed: Mar. 28, 2006

(65) Prior Publication Data

US 2007/0228749 A1 Oct. 4, 2007

(51) Int. Cl.
*A01K 29/00* (2006.01)
*E01H 1/12* (2006.01)

(52) U.S. Cl. ..... 294/1.3; 294/25

(58) Field of Classification Search ..... 294/1.3–1.5, 294/55, 25; 15/257.1, 257.6
See application file for complete search history.

(56) References Cited

U.S. PATENT DOCUMENTS

| | | | | |
|---|---|---|---|---|
| 2,244,072 | A * | 6/1941 | Ledbetter | 294/25 |
| 3,857,597 | A | 12/1974 | Young | |
| 3,917,333 | A | 11/1975 | Grattan | |
| 4,021,994 | A | 5/1977 | Mainprice | |
| 4,316,627 | A | 2/1982 | Solypa | |
| 4,431,222 | A | 2/1984 | Rotella | |
| 4,747,633 | A * | 5/1988 | Stacy | 294/1.3 |
| 4,986,587 | A | 1/1991 | Lozano | |
| 5,280,978 | A | 1/1994 | Bohn | |
| 5,290,080 | A | 3/1994 | Yoshioka | |
| 5,370,431 | A | 12/1994 | Henninger et al. | |
| 5,400,572 | A | 3/1995 | Peck et al. | |
| 5,848,928 | A * | 12/1998 | Wong | 446/329 |
| 6,062,618 | A | 5/2000 | Figueroa | |
| 6,237,972 | B1 | 5/2001 | Jung | |
| 2004/0066049 | A1 | 4/2004 | Azrikam | |
| 2005/0218675 | A1 | 10/2005 | Jung | |

FOREIGN PATENT DOCUMENTS

| | | | |
|---|---|---|---|
| EP | 0037355 | A2 * | 10/1981 |
| EP | 0454074 | * | 10/1991 |

* cited by examiner

*Primary Examiner*—Paul T Chin
(74) *Attorney, Agent, or Firm*—Liell & McNeil

(57) ABSTRACT

A pet waste collection device includes a container with first and second boxes joined with a hinge, and a handle that may be detachably attached to the collection container. The handle includes a finger portion that is slidable in an opening through a thumb portion of the handle. The handle is oriented such that the first and second boxes become extensions of the users thumb and fingers with action mimicking a grasping action while maintaining the users hand remote from any pet waste being collected. The handle may be reusable, and a plurality of collection containers may be included as part of a kit.

14 Claims, 2 Drawing Sheets

PET WASTE COLLECTION KIT, DEVICE AND METHOD

TECHNICAL FIELD

The present disclosure relates generally to the collection of pet waste, and more particularly to a hinged box container and unique sliding handle for collecting and disposing of pet waste.

BACKGROUND

The collection and disposal of pet waste has been an undesirable but necessary duty of pet owners for many years. Many pet owners and inventors have attempted to address this problem in a wide variety of ways ranging from the use of a simple scoop or bag to the relatively complex contraptions described in prior art references. But many of these devices may not be acceptable to some persons, and/or may simply not be practical. For instance, the simple use of a plastic bag to retrieve pet canine feces can present an unpleasant tactile sensation to the user, even though they are separated from the waste by the thickness of the plastic bag. This unpleasant tactile sensation can render the plastic bag unacceptable for use by many pet owners. In other instances, a variety of pet waste collecting devices are either too complex to be practical, or may include long handles and the like rendering them less than portable for everyday usage.

The present disclosure is directed to solve one or more of the problems set forth above.

SUMMARY OF THE DISCLOSURE

In one aspect, a pet waste collection device includes a first box joined to a second box with a hinge. A handle has a finger portion with one end attached to the first box, and a thumb portion with one end attached to the second box. One of the finger and thumb portions is slidably received in an opening through the other of the finger and thumb portions.

In another aspect, a pet waste collection kit can include a plurality of waste collection containers stacked on one another in a flattened configuration. A separate reusable handle can be detachably attached to a selected one of the containers.

In still another aspect, a method of collecting pet waste includes attaching respective finger and thumb portions of a handle to first and second boxes of a waste collection container. A thumb and at least one finger are inserted into an annular thumb engagement and annular finger engagement of the handle, respectively. The collection container is opened by moving the finger and thumb engagements away from one another by sliding one of the finger portion and thumb portion of the handle through one another. The pet waste is enclosed within the container by sliding the finger and thumb portions back into contact in a reverse direction.

DETAILED DESCRIPTION

Figure 3:
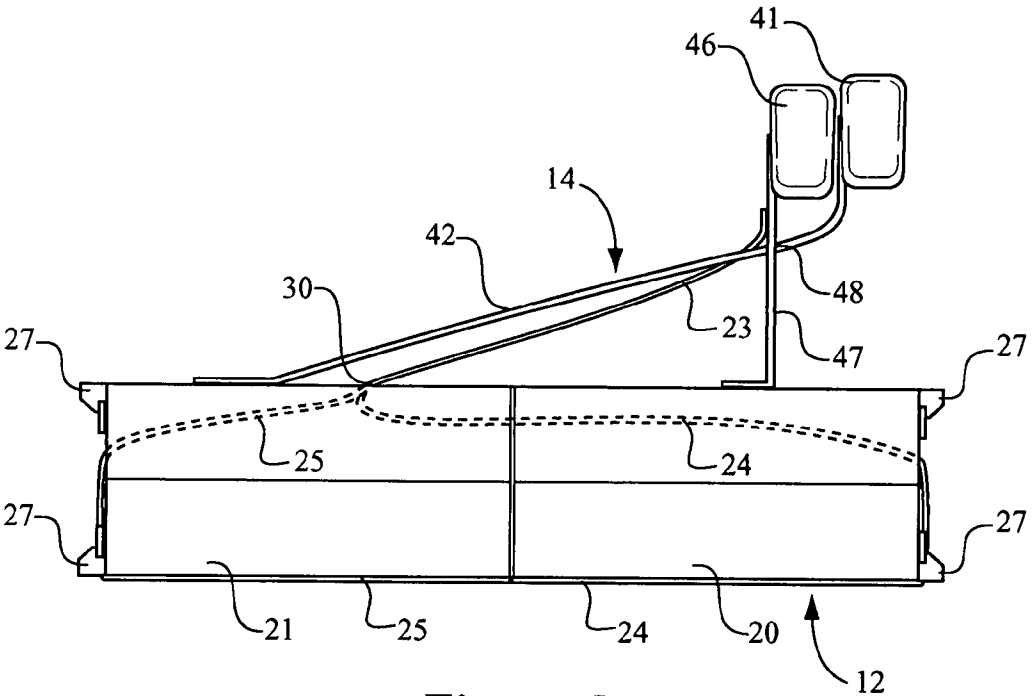
FIG. 3 is a side view of the pet collection container of FIG. 2 in an expanded configuration with a handle as shown in FIG. 1 attached thereto.
Figure 1:
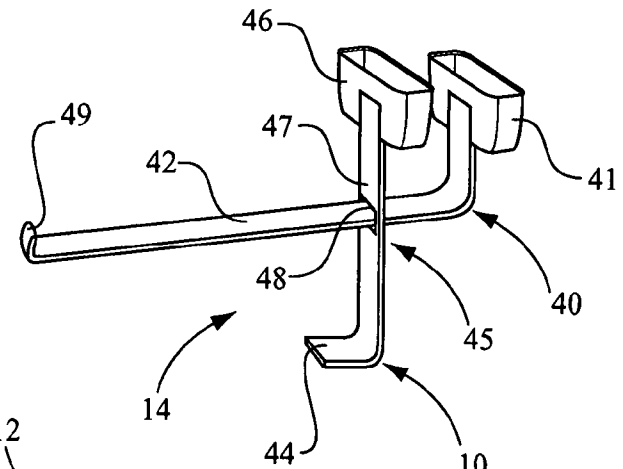
FIG. 1 is a perspective view of a pet waste collection kit according to one embodiment of the present disclosure.
Figure 1:
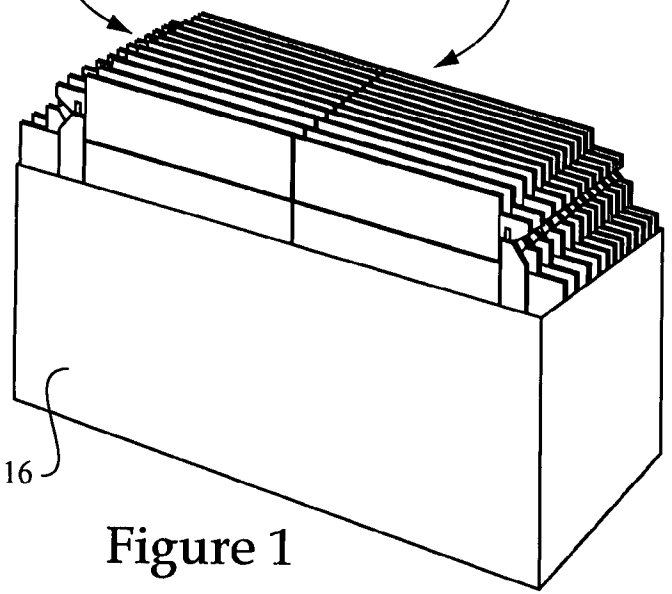
Figure 5:
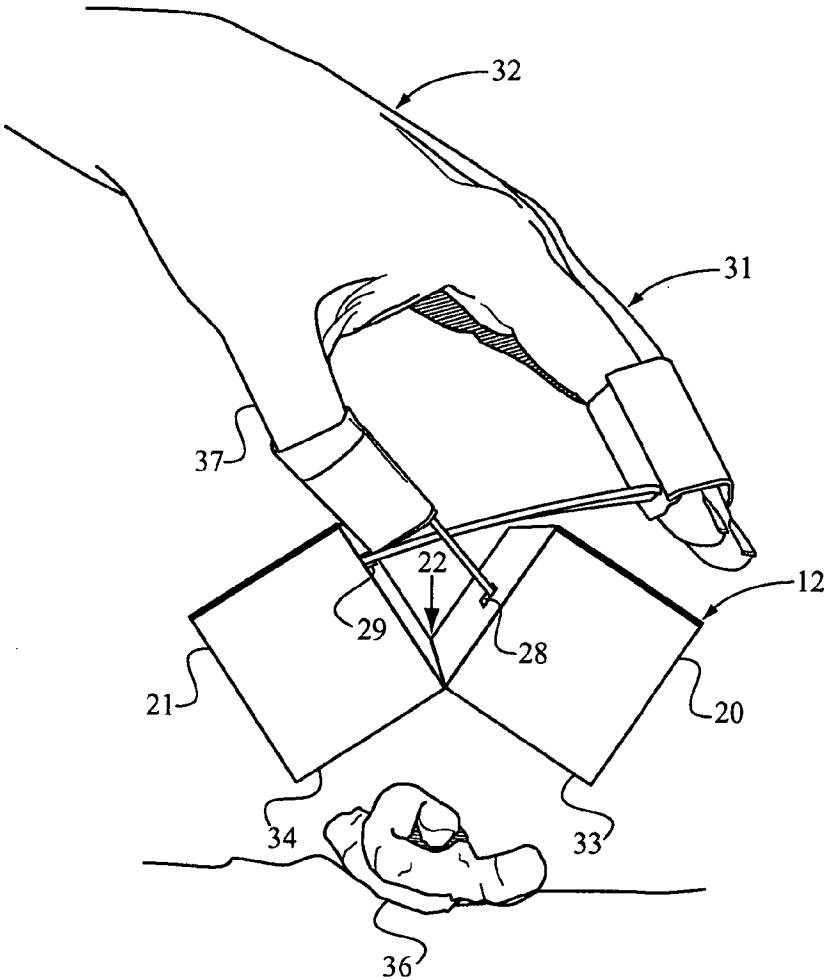
FIG. 5 is a side view of a user collecting pet waste using the pet waste collection device of the present disclosure.

Referring to FIG. 1, a pet waste collection kit 10 might include a plurality of pet waste collection containers 12 stored in flattened configurations stacked adjacent one another in a supply box 16. A separate reusable handle 14 may be detachably attached to a selected one of the collection containers 12. In one aspect, the collection containers 12 may be made from a suitable cardboard and/or plastic material, and the handle may be made from a more durable plastic material for reuse with a plurality of collection containers 12. Handle 14 includes a finger portion 40 with an extension 42 that includes an annular finger engagement 41 at one end, and a hook 49 (or other equivalent attachment) at its other end. Handle 14 also includes a thumb portion 45 that includes an extension 47 with an annular thumb engagement 46 at one end and a hook 44 at its opposite end. One of the finger and thumb portions includes an opening 48 that receives the other of the finger and thumb portions for sliding engagement through the opening. In the illustrated embodiment, thumb portion 45 includes a slot shaped opening 48 that permits the annular finger and thumb engagements 41, 46 to be slid together as shown in FIGS. 1 and 3, or apart as shown in FIG. 5. Although the handle is shown as including hooks 44 and 49 for detachable attachment to respective collection containers 12, those skilled in the art will appreciate that other configurations, such as cooperating slots and tabs could be substituted in place without departing from the intended scope of the present disclosure.

Figure 2:
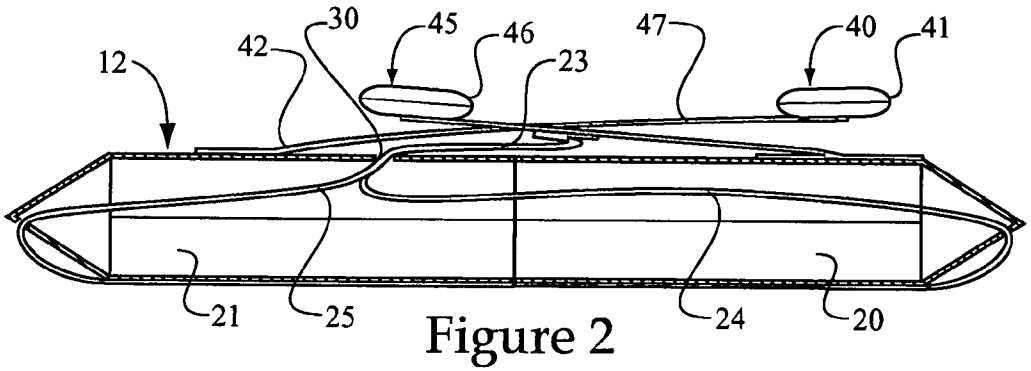
FIG. 2 is a sectioned side view of a pet collection container in a flattened configuration.
Figure 4:
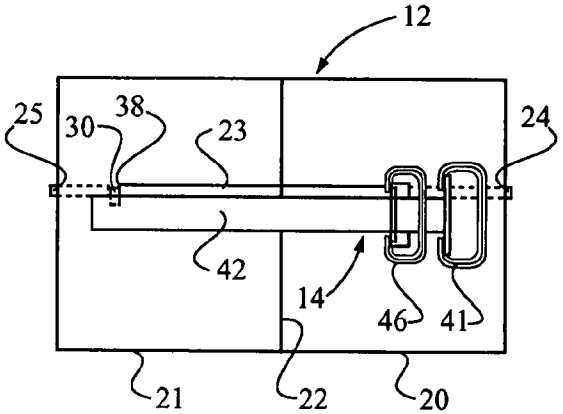
FIG. 4 is a top view of the pet collection container of FIG. 3.

Referring now to FIGS. 2-4, a collection container 12 is shown in its flattened configuration and expanded configuration. Although not necessary, the collection container 12 may include a pull tab actuator 23 and a pair of straps 24 and 25 that can be utilized to assist in expanding the collection container from its flattened configuration as shown in FIG. 2 to its expanded configuration as shown in FIG. 3. Pull tab 23 may be attached to extension 47 of thumb portion 45, as shown, or may be detached. In addition, although not necessary, the storage container 12 may be equipped with a locking feature that assists in maintaining the collection container 12 in an expanded configuration. For instance, a plurality of interlocking tabs 27 may be added to the basic container construction in order to provide a locking feature that holds container 12 in its expanded configuration as shown in FIG. 3. Those skilled in the art will appreciate that, although interlocking tabs 27 are illustrated, any suitable locking feature, such as cooperating slots and tabs could be substituted in place without, departing from the intended scope of the present disclosure. Thus, those skilled in the art will appreciate that a wide variety of equivalent locking feature strategies are available to the present disclosure. One such alternative locking strategy is shown in FIG. 4 where pull tab 23 includes a notch 38 that cooperates with opening 30 in second box 21 to lock pull tab 23 and its associated straps 24 and 25 in the expanded position shown in FIGS. 3 and 4. The pull tab strap 23 may bear against extension 42 of finger portion 40 in order to maintain the notch 38 engaged in a locked position at opening 30 as shown in FIG. 4.

In its basic configuration, the pet waste collection device includes a container 12 and a handle 14. In one aspect, the handle is detachable for reuse, in other contemplated embodiments, the handle would also be disposable and permanently attached to the container 12. Collection container 12 may include a first box 20 that is connected to a second box 21 via a living hinge 22. The respective first and second boxes can be made from any suitable material, such as a disposable and biodegradable cardboard material, but it can also be made from other suitable materials, such as plastic. The living hinge 22 (FIG. 4) can be as simple as a fold in the cardboard or be a segment of tape that joins the two boxes together. Thus, those skilled in the art will appreciate that the container 12 could be cut from a single sheet of cardboard and include appropriate folds and joints to have the ability to assume a flattened configuration or an expanded configuration as shown.

In the event that the container 12 includes an expansion device, such as pull tab actuator 23, it may take the configuration that includes a pair of straps 24 and 25 that extend through the inside of boxes 20 and 21 and then out through openings in the ends of the boxes and then reattaching on the underside of the same as shown in FIGS. 2-4. Thus, when pull tab 23 is pulled, such as by lifting thumb portion 45, straps 25 and 24 are pulled through an opening 30 in box 21 and cause both boxes 20 and 21 to move away from the flattened configuration of FIG. 2 to the expanded configuration as shown in FIGS. 3 and 4. When the boxes 20 and 21 reach their expanded configuration, the interlocking tabs 27 will be received in respective catches of adjacent tabs 27 to irreversibly maintain the container 12 in the expanded configuration. Alternatively, or in addition, boxes 20 and 21 may be located in the expanded configuration via the cooperation of notch 38 with opening 30 as shown in FIG. 4.

Figure 6:
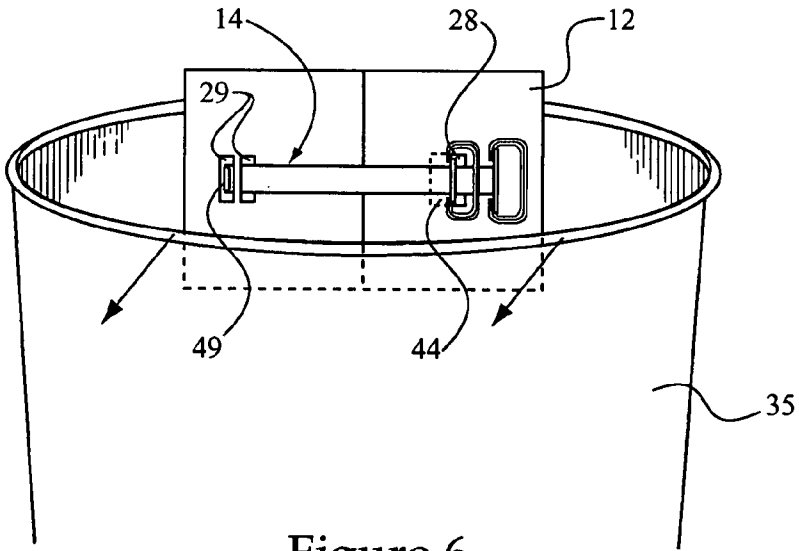
FIG. 6 is a perspective view the pet waste collection device of FIG. 5 being detached from the handle for disposal after collecting the animal waste.

Although handle 14 may be permanently attached, such as via glue, and thus disposable like container 12, preferably handle 14 has a more robust construction to enable it to be used over and over again with disposable containers 12. Thus, in the illustrated embodiment of FIGS. 1, 5, and 6, the handle 14 includes exposed hooks 44, 49 that may be engaged with respective slots 28 and 29 of the first and second boxes 20 and 21. For instance, the thumb portion hook 44 may be detachably attached in one or more slots 28 cut into the top surface of box 20, and the finger portion hook 49 may likewise be detachably attached to one or more slots 29 made in the top surface of box 21. In the illustrated embodiment, box 20 includes a first handle attachment slot 28 that receives hook 44, and the second box 21 includes a second handle attachment slots 29 that receives hook 49. The slots are configured to allow the handle to open and close container 14 as shown in FIG. 5 without becoming detached from container 12.

INDUSTRIAL APPLICABILITY

In practice, a pet owner may have a complete kit 10 as shown in FIG. 1 that includes a plurality of containers 12 and a handle 14. When it is time to take their pet for a walk, the pet owner will simply retrieve a container 12 from supply box 16 and possibly maintain the storage box in a flattened configuration for convenience until time for use. Although the present disclosure contemplates collection containers that are always in a expanded configuration, a user of a collapsible version will first need to expand the collection container from the flattened configuration as shown in FIG. 2 to the expanded configuration as shown in FIGS. 3 and 4. This can be done by gripping pull tab actuator 23 and lifting the extension 47 of thumb portion 45 the same away from the top surface of boxes 20 and 21. This will result in straps 24 and 25 being displaced upward through opening 30, placing forces on the respective boxes 20 and 21 causing them to move toward an expanded configuration. When they reach an expanded configuration, interlocking tabs 27 will be received in respective cuts made in cooperating tabs and will lock the boxes in their expanded configuration for use, as shown in FIG. 3. Alternatively, or in addition, tab 23 may include a notch 38 that cooperates with opening 30 to lock boxes 20 and 21 in the expanded configuration as shown in FIG. 4.

In another aspect, handle 14 may be detachably attached to the container 12. This may be accomplished by inserting hook 49 through a first handle attachment slots 29 in the second box 21, and inserting thumb portion hook 44 in a similar handle attachment slot 28 in first box 20.

Next, the pet owner inserts one or more fingers 31 of their hand 32 into the annular finger engagement 41 of the finger portion 40 of handle 14. The pet owner then inserts their thumb into the annular thumb engagement 46 of the handle 14 as shown in FIG. 4. When the annular finger and thumb portions 41 and 46 thumb engagements are in contact with one another as shown in FIG. 3, the open sides 33 and 34 of boxes 20 and 21 are adjacent one another to form an enclosure as shown in FIG. 3. When the annular finger and thumb engagements 41 and 46 are moved away from each other as shown in FIG. 5, the open sides 33 and 34 or boxes 20 and 21 allow the open sides 33 and 34 to be positioned over pet waste 36. When the pet owners thumb 37 and finger(s) 31 are moved back together to the configuration shown in FIG. 3, the pet waste is retrieved within container 12. Next, the pet owner can release the container 12 holding the pet waste by partially positioning the container 12 in a suitable receptacle, such as a garbage can 35. When an asymmetrical force is applied to the container 12 by an interaction with a rim of the garbage can and a pulling force on handle 14 away from container 12, the hooks 44 and 49 will break free of container 12 and the container holding the pet waste 36 will drop into garbage can 35. The handle 14 may then be stored away for future use. Alternatively, if the permanently attached handle version is being used, the container with handle are discarded with the waste trapped inside.

By utilizing the unique handle 14 construction that has action somewhat similar to that of scissors, but has a different orientation so that the handle 14 and container 12 function as extensions of normal hand movement during a grasping or picking up movement of finger toward and away from the thumb. However, the handle and container 12 keep the pet owner remote from, but in proximity of, the pet waste avoiding any of the undesirable tactile sensations experienced by those who utilize an inverted plastic bag to retrieve the pet waste. In addition, because the boxes are substantially more rigid than a plastic bag, they can be used in a scooping action to help insure that the waste is received in one or both of the boxes 20 and 21 during the collection procedure.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A pet waste collection device comprising:

a first box joined to a second box with a hinge;

a handle having a finger portion with one end attached to the first box and a thumb portion with one end attached to the second box;

one of the finger portion and thumb portion being slidably received in an opening through the other of the finger portion and thumb portion, the first box and the second box being rotatable relative to one another about the hinge between an open, waste receiving state and a closed, waste trapping state by sliding the one of the finger portion and the thumb portion within the opening.

2. The device of claim 1 wherein the first and second boxes have a flattened configuration that is moveable to an expanded configuration.

3. The device of claim 2 including a pull tab actuator operable to move the first and second boxes from the flattened configuration to the expanded configuration.

4. The device of claim 2 including a locking feature operable to lock the first and second boxes in the expanded configuration.

5. The device of claim 4 wherein the locking feature includes of plurality of interlocking tabs.

6. The device of claim 2 wherein the handle includes a detachment feature operable to disconnect the handle from the first and second boxes in response to an asymmetrical force on the first and second boxes in a direction away from the handle.

7. The device of claim 6 including a locking feature operable to lock the first and second boxes in the expanded configuration.

8. The device of claim 1 wherein the handle includes a detachment feature operable to disconnect the handle from the first and second boxes in response to an asymmetrical force on the first and second boxes in a direction away from the handle.

9. The device of claim 1 wherein the finger portion includes an annular finger engagement;

the thumb portion includes an annular thumb engagement; and the boxes forming an enclosure when the annular finger engagement contacts the annular thumb engagement are together.

10. A pet waste collection kit comprising:

a plurality of waste collection containers stacked on each other, with each of the containers being in a flattened configuration, and the containers including first and second boxes joined with a hinge;

a handle for detachable attachment to a selected one of the containers; and a handle having a finger portion with one end attached to the first box and a thumb portion with one end attached to the second box;

one of the finger portion and thumb portion being slidably received in an opening through the other of the finger portion and thumb portion;

wherein the first box and the second box of each of the waste collection containers are rotatable relative to one another about the hinge between an open, waste receiving state and a closed, waste trapping state by sliding the one of the finger portion and the thumb portion within the opening.

11. The kit of claim 10 including a locking feature operable to lock the first and second boxes of each container in an expanded configuration.

12. The kit of claim 11 including a pull tab actuator operable to move the first and second boxes from the flattened configuration to the expanded configuration.

13. The kit of claim 10 wherein the finger portion includes an annular finger engagement;

the thumb portion includes an annular thumb engagement; and the boxes forming an enclosure when the annular finger engagement contacts the annular thumb engagement.

14. The kit of claim 10 wherein the handle includes a detachment feature operable to disconnect the handle from the first and second boxes in response to an asymmetrical force on the first and second boxes in a direction away from the handle.

* * * * *